US009309100B2

(12) United States Patent
Crane

(10) Patent No.: US 9,309,100 B2
(45) Date of Patent: Apr. 12, 2016

(54) CARTRIDGE BOTTLE OPENER APPARATUS AND RELATED METHODS

(71) Applicant: Elijah Crane, San Diego, CA (US)

(72) Inventor: Elijah Crane, San Diego, CA (US)

( * ) Notice: Subject to any disclaimer, the term of this patent is extended or adjusted under 35 U.S.C. 154(b) by 384 days.

(21) Appl. No.: 13/935,397

(22) Filed: Jul. 3, 2013

(65) Prior Publication Data

US 2015/0007698 A1 Jan. 8, 2015

(51) Int. Cl.
*B67B 7/16* (2006.01)

(52) U.S. Cl.
CPC ..... *B67B 7/16* (2013.01)

(58) Field of Classification Search
CPC ..... B25B 27/02; B25B 27/14; B25B 19/025; B25B 27/023; B23Q 3/183; B67B 7/16; B67B 7/10
See application file for complete search history.

(56) References Cited

U.S. PATENT DOCUMENTS 3,848,350 A * 11/1974 Seminiano ..... F42B 8/08 102/444
3,895,459 A * 7/1975 Morrison ..... F41B 7/08 42/54
5,033,386 A * 7/1991 Vatsvog ..... F42B 5/307 102/430
5,758,445 A * 6/1998 Casull ..... F42B 5/26 42/25
2015/0007698 A1* 1/2015 Crane ..... B67B 7/16 81/3.55

* cited by examiner

*Primary Examiner* — Lee D Wilson
(74) *Attorney, Agent, or Firm* — Buche & Associates, P.C.; John K. Buche; Bryce A. Johnson

(57) ABSTRACT

Disclosed are various embodiments of an apparatus in the form of a cartridge opener for bottles and methods of using the same. Preferable embodiments of the apparatus are in the form of rifle cartridges. Further disclosed is a cartridge bottle opener featuring a unique opener with a tooth that is properly sized, weighted and cut in dimensions that are best suited for rapid entry of a beverage and removal of a bottle cap.

6 Claims, 9 Drawing Sheets

CARTRIDGE BOTTLE OPENER APPARATUS AND RELATED METHODS

CROSS-REFERENCE TO RELATED APPLICATIONS

Not applicable

STATEMENT REGARDING FEDERALLY SPONSORED RESEARCH OR DEVELOPMENT

Not applicable.

BACKGROUND OF THE INVENTION

When a person is thirsty for a beverage contained in a bottle, it is of paramount importance to be able to open the bottle as quickly as possible. Furthermore, it is imperative that whatever contrivance is being used to access such bottle be readily accessible to the user.

There are a variety of bottle openers on the market for the purposes of opening a bottle and removing a bottle cap, however, many of them feature limitations in either their operation or their style. Sometimes these limitations are in the form of the weight, shape, or size of the opener.

SUMMARY OF THE INVENTION

Disclosed are various embodiments of an apparatus in the form of a cartridge opener for bottles and methods of using the same. Preferable embodiments of the apparatus are in the form of rifle cartridges.

Further disclosed is a cartridge bottle opener featuring a unique opener with a tooth that is properly sized, weighted and cut in dimensions that are best suited for rapid entry of a beverage and removal of a bottle cap.

DETAILED DESCRIPTION OF THE INVENTION

Figure 1:
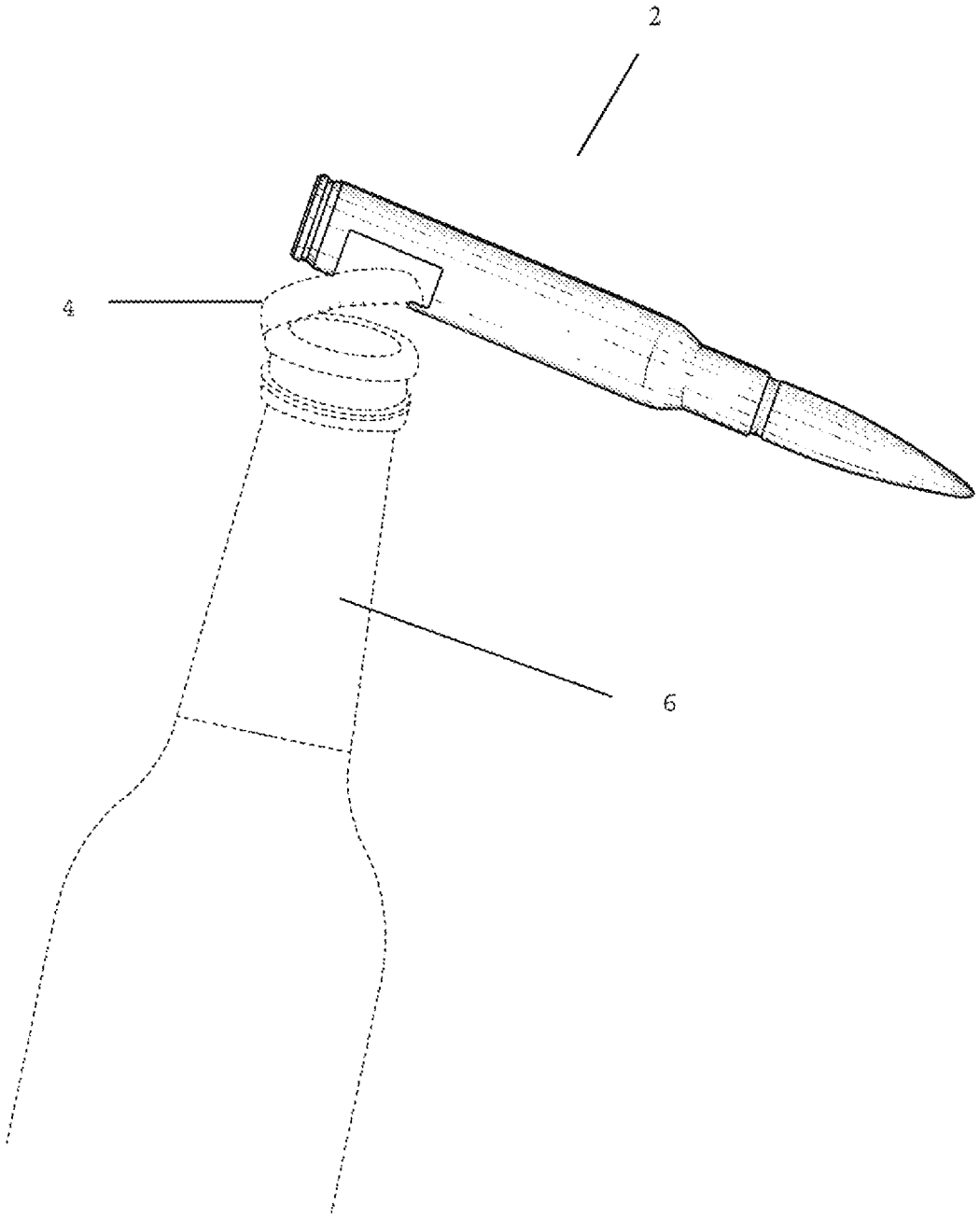
FIG. 1 is a perspective view of cartridge bottle opener of the present invention as it is being used to remove a bottle cap.

Throughout the description, the following terms are used:
cartridge opener 2,
bottle cap 4,
bottle 6,
casing 8,
aperture 10,
tooth 12,
bullet 14,
rim 16,
bullet end 18,
primer 20,
shoulder 22,
cannelure 24,
neck 26,
magnetic surface (i.e. refrigerator) 28,
magnet 30.
stopper 32.

FIG. 1 is a contextual drawing that shows the cartridge opener 2 of the present invention as it is typically used to open a bottle cap 4 on a beverage bottle 6. While outward appearances are that of a rifle cartridge, there is a cut out in the casing which permits efficient opening of the bottle 6. As depicted, the user may invert the cartridge and removably secure a "tooth" disposed in a cut out (aperture 10) of the cartridge under the bottle cap 4. From that point, user has a very efficient lever to swiftly remove a bottle cap 4. The aperture 10 is ideally suited to accommodate the bottle cap 4 of a bottle, which may be fitted therein and securely engaged and then leveraged off the bottle.

Figure 2:
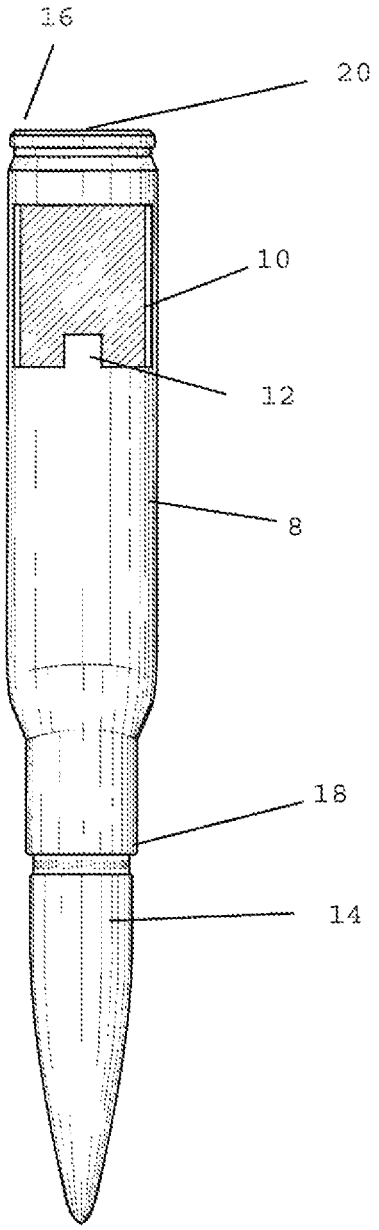
FIG. 2 is a forward facing view of the cartridge opener of the present invention which shows a suitable aperture.
Figure 3:
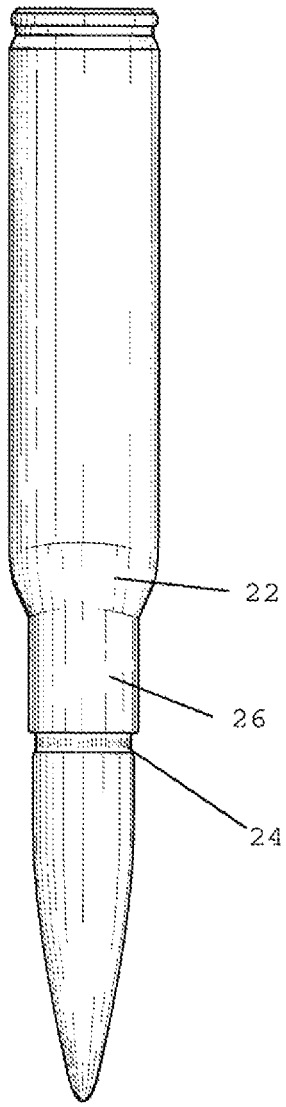
FIG. 3 is a rear facing view of the cartridge opener of the present invention.

FIGS. 2 and 3 provide additional detail of preferable embodiments of the present invention. As shown, a preferable embodiment is that of a typical .50 caliber rifle cartridge. This is a rifle round that is ell-respected in shooting communities, but also has sufficient weight and size to be an ideal lever for the purposes of the present invention, once suitably modified. The cartridge features a bullet 14 (typically with a full metal jacket). This is disposed at the bullet end 18 of the cartridge. The cartridge has a casing 8 which forms the main body of the cartridge opener 2. Toward the rear of the rifle cartridge is disposed a rim 16, which also features a primer 20, which has been expended. Of course, this particular cartridge will not feature any gunpowder since the purpose of the cartridge is not actually for deployment in a weapon, but is for the purpose of recreation and opening beverages in an efficient, gratifying and stylish manner. Disposed in the rearward portion of the casing 8 is an aperture 10. The aperture 10 is generally cut in the shape of a square or a rectangle. An important feature of the aperture 10 is what is referred to as a tooth 12, which is situated on the bullet end 18 of the aperture. Other typical features of a rifle cartridge are shown in FIG. 3, namely the shoulder 22, the cannelure 24 on the bullet, as well as the neck 26 of the cartridge. The shoulder 22 and neck 26 of the cartridge are part of the casing 8.

Figure 4:
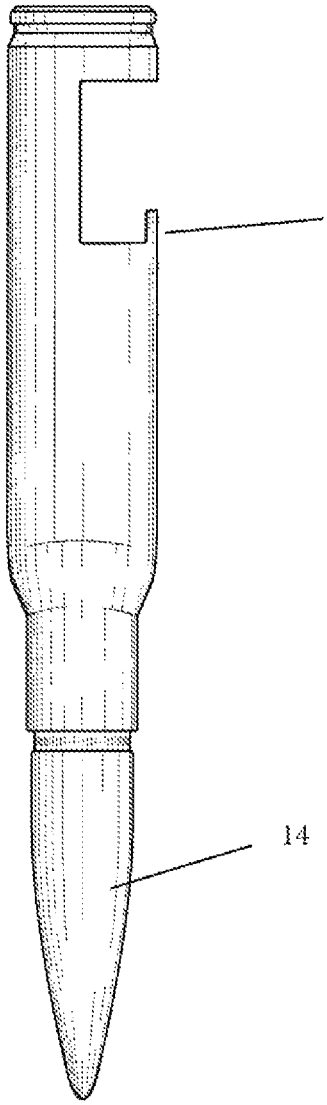
FIG. 4 is a side facing view of the cartridge opener of the present invention wherein suitable configuration of an aperture may also be viewed.
Figure 5:
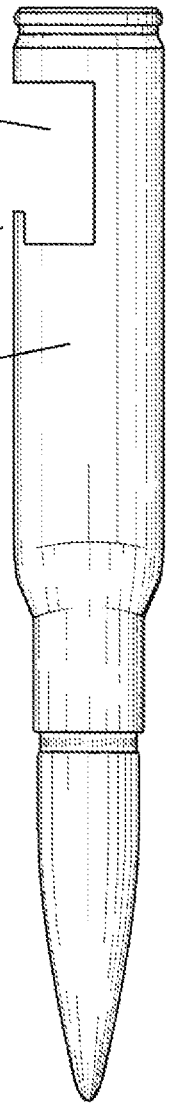
FIGS. 5, 6, and 7 are alternate views of the same cartridge over a figure for including views looking from top and bottom.

FIGS. 4 and 5 are important in as much as they show preferable dimensions of the aperture 10 of the present invention as well as preferable dimensions of the tooth 12. A properly sized aperture is important because it must accommodate for the size of a typical bottle cap 4 on a bottle 6 such as a beer or soda bottle. It rust have appropriate dimensions, yet, the casing 8 and the tooth 12 must have adequate size to properly lever on the bottle cap 4. Applicant has found a .50 caliber cartridge to be of an ideal size for purposes of opening a bottle. Applicant has determined that one preferable range of length (meaning lengthwise along the cartridge) for the aperture 10 is in the range of 0.5-1.0 inches in length. Still, more preferable is a length of 0.875 inches. A preferable size for the gap between the top of the tooth 12 and the top of the aperture 10 is at least 0.5 inches. More preferable still, is a gap of 0.625 inches. The tooth 12 is preferably of a length of at least 0.2 inches with a still preferable size being that of 0.245 inches and with the preferable width of at least 0.2 inches and more preferable still, a width being 0.307 inches. The length and the width of the tooth 12 is an important factor because if it is too wide it will obstruct the bottle cap 4, whereas if it is too narrow it will not adequately leverage the bottle cap 4 on a bottle or it will slide off, which can be an annoying experience for the user. The tooth 12 is beneficial because it allows both a proper overall size opening and yet accomplishes excellent leverage and grip. Overall, the aperture 10 may be cut to an approximate midpoint of the casing 8, which is seen in FIG. 4 and FIG. 5. As may also be seen, the aperture 10 is disposed toward the rearmost portion of the casing 8. One preferable placement for the opening for the aperture 10 is 0.5 inches from the rim 16 of the cartridge opener 2. Applicant has determined that this orientation provides the best weight and leverage considering the considerable weight of the bullet 14 disposed at the opposite end of the casing 8. particularly, on a .50 caliber cartridge, the weight and leverage angle provides an ideal experience and comfort in the hand of a user. Also, the disclosed orientation and position on the aperture 10 provides for great ease of removal of a bottle cap with minimal force using the wrist.

Figure 6:
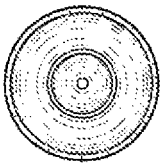
Figure 7:
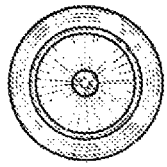

FIGS. 6 and 7 simply show the top and bottom views of the cartridge opener 2 of the present application.

Figure 8:
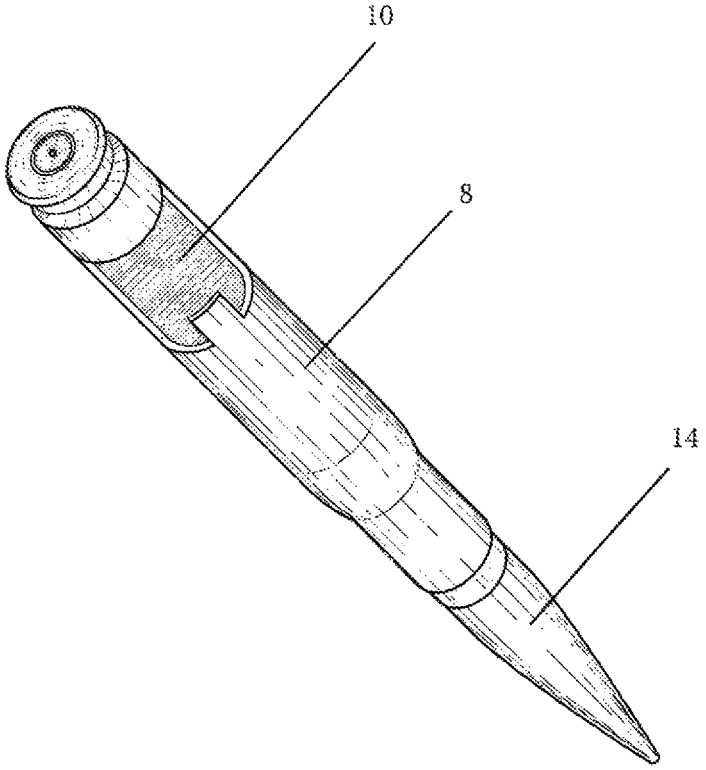
FIG. 8 is a perspective view of the cartridge of the present invention where one may view the rim and rearward facing primer, which is spent in this embodiment.

FIG. 8 is a perspective view that shows the various aforementioned features of the cartridge opener 2. From this vantage point, it is also possible to see how the aperture 10 on a .50 caliber bullet is particularly suited to provide adequate space to accommodate the bottle cap 4 on a typical beer or soda bottle. Other cartridge sizes are contemplated; however, a .50 caliber cartridge is most preferable.

Figure 9:
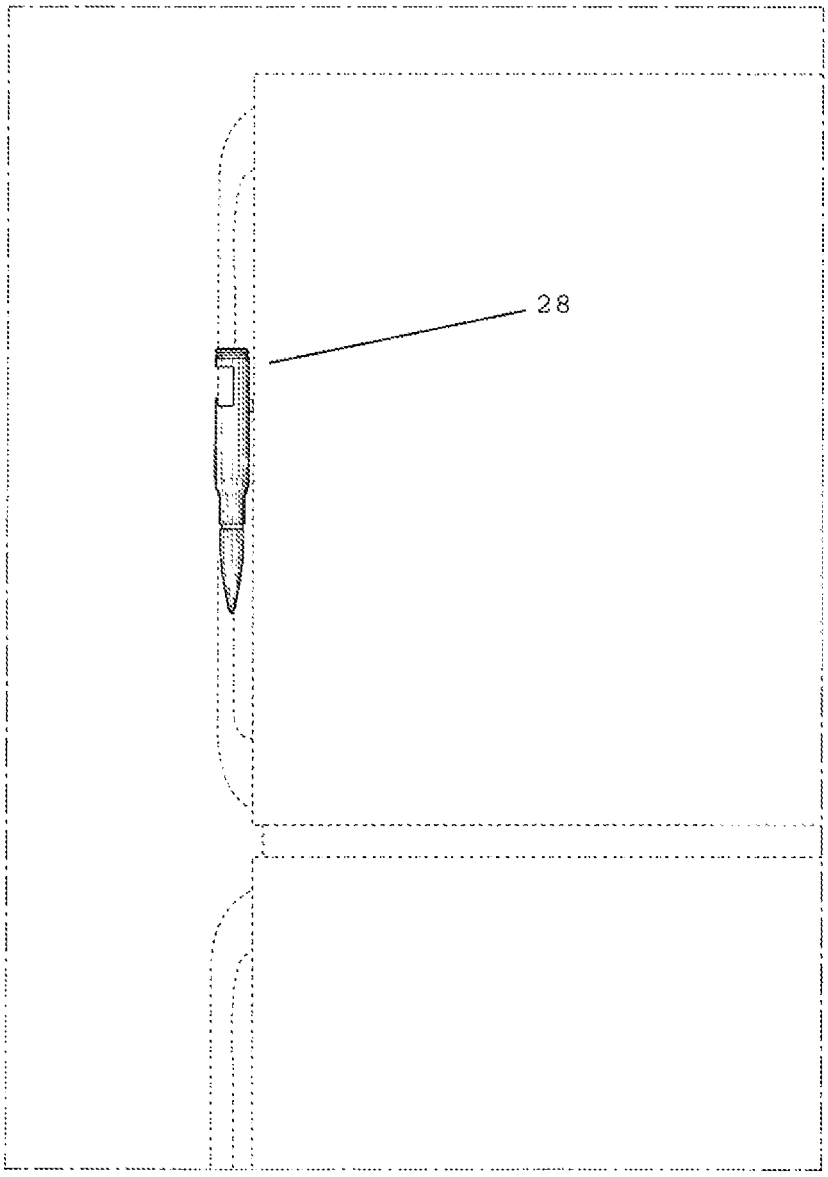
FIG. 9 is a contextual image of the cartridge opener of the present invention as it is removably secured on a magnetic surface prior to use.

FIG. 9 represents another embodiment of the cartridge opener 2 of the present application and depicts the apparatus as it may be used and secured to a magnetic surface 28, such as a refrigerator. Persons looking to open a beverage with a bottle 4 typically want to open the beverage near the refrigerator 28. Rather than fumbling around in drawers or in other locations, the applicant has determined that attachment to a refrigerator's magnetic surface 28 or a nearby metal surface is preferable. In the context of a .50 caliber bullet cartridge, which has a considerable weight, magnetic attachment without impeding the aperture 10 must be done correctly. The magnet must be a suitable strength to hold the considerable weight of the cartridge and it must be properly positioned to prevent undesired sliding of the cartridge opener 2.

Figure 10:
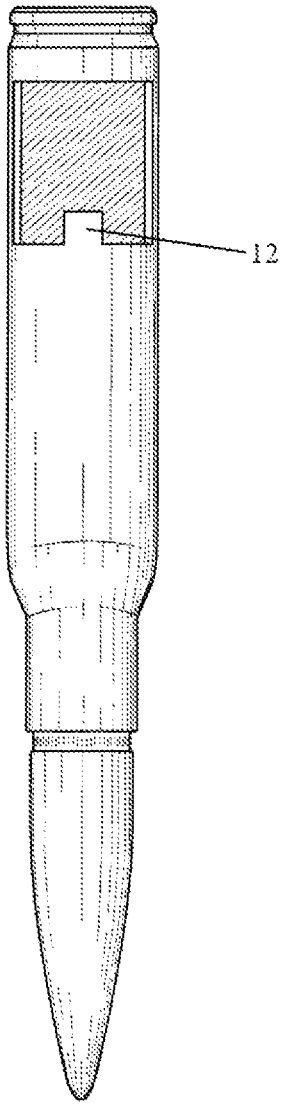
FIGS. 10 and 11 are forward and rearward facing views of an embodiment of the present cartridge opener that also features a magnet.
Figure 11:
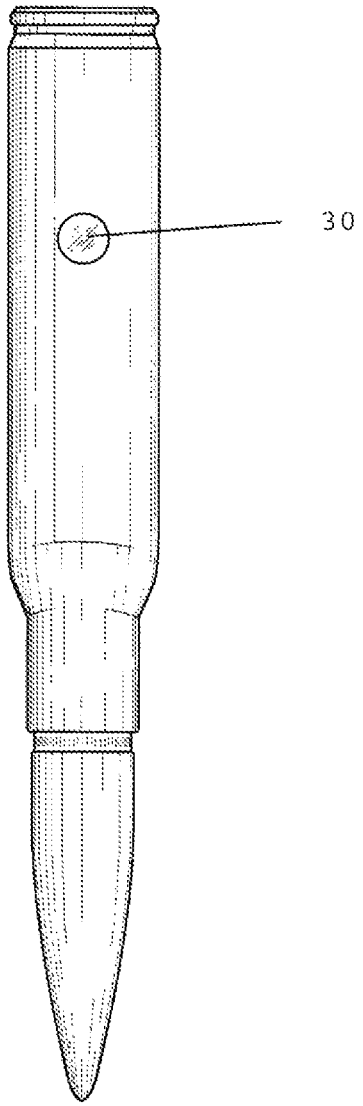

FIGS. 10 and 11 show one preferable placement for a magnet 30 to secure the cartridge opener 2. These figures show an embodiment where the magnet is secured to the rear of the casing 8. In this particular embodiment, the magnet is fixedly attached and protrudes out of the rear casing 8. The magnet 30 is typically a "super" magnet. These are often neodymium disc magnets.

Figure 12:
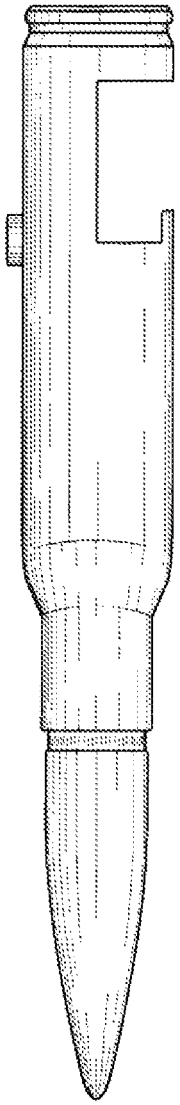
FIG. 12 through 17 are various views that demonstrate preferable placements of magnet(s) disposed on the cartridge of the present invention.
Figure 13:
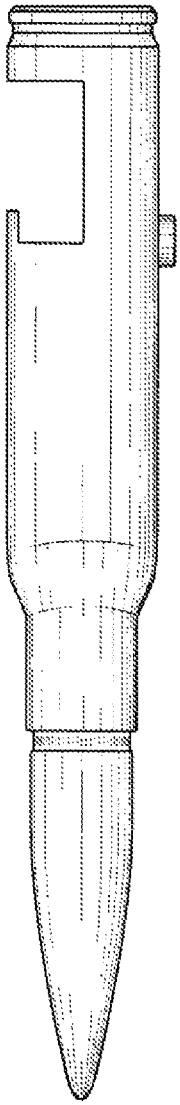
Figure 14:
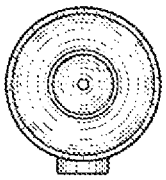
Figure 15:
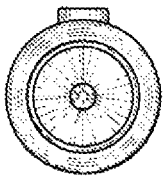
Figure 16:
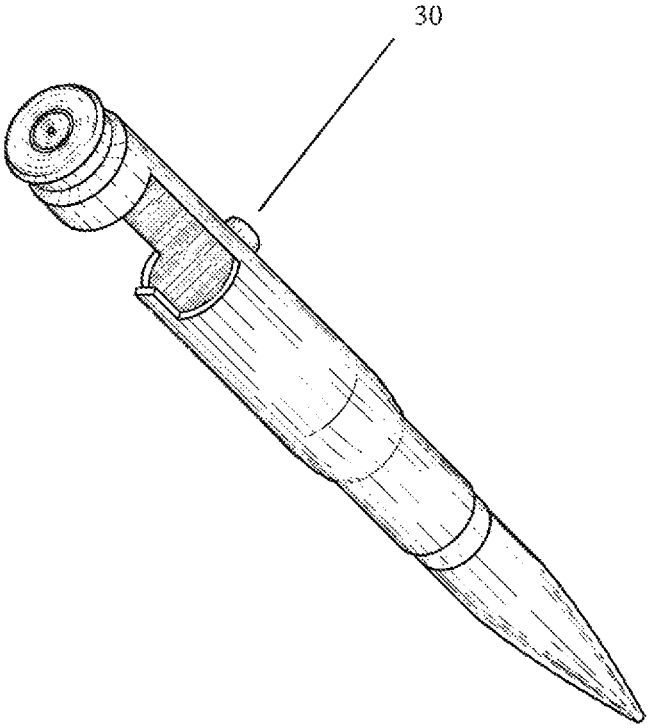
Figure 17:
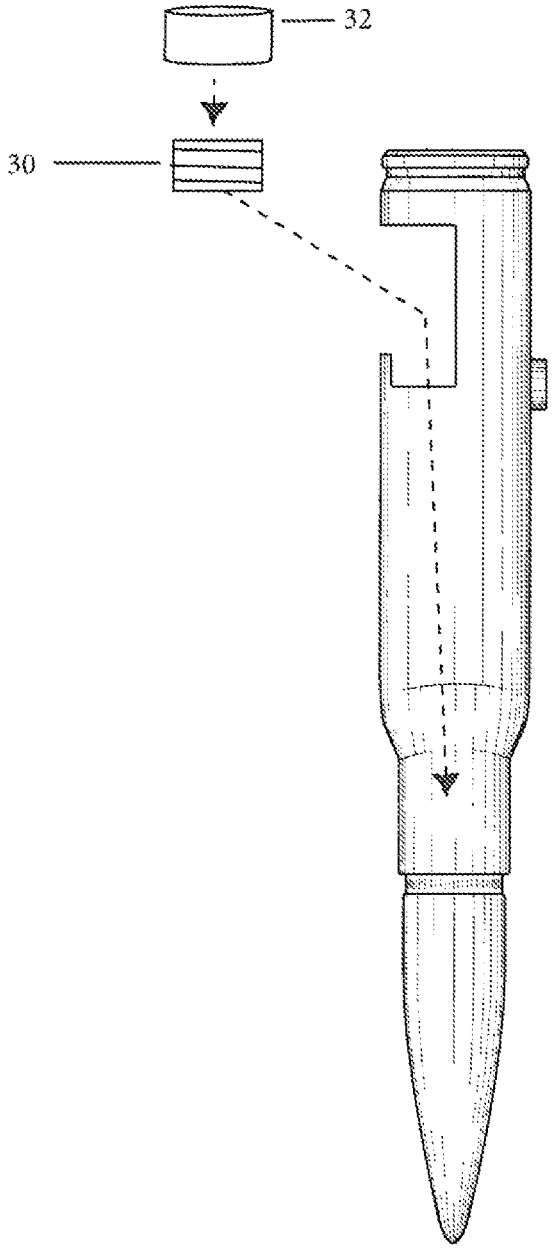

As shown in FIGS. 12 and 13, a magnet 30 is preferably centrally disposed or slightly offset from a midpoint of the casing 8 on the side opposite of the aperture 10.

FIG. 12-16 are perspective drawings that show the appearance in three dimensions of this embodiment with an externally located magnet 30.

In yet another embodiment of the present invention, a magnet 30 is fixedly disposed internally of the casing 8 of the cartridge opener 2. A cartridge with magnetic properties may be fashioned by disposing one or more magnet(s) 30 inside the casing 8 and then securing the magnet(s) 30 with an adhesive means, which may be secured either below, around, or on top of the magnet(s). One preferable location for securing such a magnet is toward the shoulder 22 inside the casing 8. Adhesive may be injected through the aperture 10 on top and/or around the magnet 30. The magnet 30 may be internally fixed anywhere along the inside casing although applicant has found it preferable to secure the magnet 30 in a manner that when the cartridge is fixed on a magnetic surface, such as a refrigerator 28, the aperture 10 faces outward. The magnet 30 may be fixedly attached via insertion through the casing 8 with a properly sized cut out. The magnet 30 may also be secured via an epoxy substrate or adhesive.

Yet still another method of fabricating a magnetic version of this present invention is to obtain a cartridge opener 2 and insert at least one magnet (or preferably four) into the body cavity (casing) of the cartridge (typically toward the bullet end), and then plug the magnets inside the casing with a rubber/plastic stopper 32. One preferable stopper/cap may be formed from vinyl, polyethylene, polypropylene or other soft plastic so that it is fashioned to accommodate the inner dimensions of the casing and so it will best hold the magnets 30. The stopper 32 may be jammed down on the magnets with a wedge or instrument to hold them securely. This latter method is beneficial because it avoids the stickiness associated with glues and adhesives, and it preserves the overall shape of the cartridge while allowing it to be magnetized.

The cartridge opener 2 may be fashioned from a variety of materials, although, metal is preferred and in some cases chrome or other precious metals may be used or plated onto the cartridge opener 2. some cases, powder coating and heat treatments may be used on the cartridge and particularly on or around the aperture 10 to prevent chipping or damage to the surfaces from repeated use with a bottle cap 4.

It is to be noted respecting each of the foregoing descriptions that the appended figures illustrate only typical embodiments disclosed in this specification, and therefore, are not to be considered limiting of its scope, for the invention may admit to other equally effective embodiments that will be appreciated by those reasonably skilled in the relevant arts. The components in the figures are not necessarily to scale, unless otherwise noted, but with an emphasis instead being placed upon illustrating the principles of the invention.

The invention claimed is:

1. A method of fabricating a rifle cartridge bottle opener comprising the steps of:

a. obtaining a rifle cartridge that has been fired so that the original bullet has been spent, and a new bullet has been re-fitted to the spent cartridge, but where the cartridge contains no gunpowder;

b. cutting an aperture in a casing of said cartridge, which aperture is operationally configured to receive and leverage a bottle cap off of a bottle.

2. The method of claim 1 wherein said aperture is cut to define a tooth.

3. The method of fabricating a rifle cartridge bottle opener of claim 1 further comprising securing at least one magnet to said rifle cartridge.

4. The method of fabricating a rifle cartridge bottle opener of claim 3 further comprising the step of delivering said at least one magnet through the aperture and securing it within a casing of said rifle cartridge.

5. The method of claim 4 wherein said at least one magnet is secured via a stopper inside said casing.

6. The method of claim 3 wherein at least one magnet is secured via an adhesive inside said casing.

* * * * *